US007215528B2

(12) United States Patent
Morganti et al.

(10) Patent No.: US 7,215,528 B2
(45) Date of Patent: May 8, 2007

(54) TURN-ON COIL DRIVER FOR ELIMINATING SECONDARY DIODE IN COIL-PER-PLUG IGNITION COILS

(75) Inventors: Carl R. Morganti, Farmington Hills, MI (US); James J. Klocinski, Saline, MI (US)

(73) Assignee: Ford Motor Company, Dearborn, MI (US)

( * ) Notice: Subject to any disclaimer, the term of this patent is extended or adjusted under 35 U.S.C. 154(b) by 680 days.

(21) Appl. No.: 10/657,591

(22) Filed: Sep. 8, 2003

(65) Prior Publication Data

US 2005/0052818 A1 Mar. 10, 2005

(51) Int. Cl.
*F23Q 3/00* (2006.01)

(52) U.S. Cl. ..... 361/247

(58) Field of Classification Search ..... 361/247
See application file for complete search history.

(56) References Cited

U.S. PATENT DOCUMENTS

| | | | | |
|---|---|---|---|---|
| 3,937,200 A | | 2/1976 | Sleder et al. | 123/148 MC |
| 4,502,454 A | | 3/1985 | Hamai et al. | 123/597 |
| 4,825,844 A | | 5/1989 | Fasola | 123/643 |
| 5,181,498 A | * | 1/1993 | Koiwa et al. | 123/633 |
| 5,476,084 A | * | 12/1995 | Morganti et al. | 123/637 |
| 5,581,131 A | | 12/1996 | Urushiwara et al. | 307/10.6 |
| 5,754,051 A | | 5/1998 | Miyata et al. | 324/393 |
| 5,842,456 A | * | 12/1998 | Morganti | 123/606 |
| 6,142,130 A | | 11/2000 | Ward | 123/606 |
| 6,216,678 B1 | | 4/2001 | James et al. | 123/594 |
| 6,427,673 B2 | * | 8/2002 | Morganti et al. | 123/633 |

FOREIGN PATENT DOCUMENTS

GB 2 166 492 A 5/1986

* cited by examiner

*Primary Examiner*—Stephen W. Jackson
(74) *Attorney, Agent, or Firm*—Mark Sparschu; MacMillan, Sobanski & Todd, LLC

(57) ABSTRACT

A circuit for controlling an ignition coil that attenuates the feed forward voltage by slowing the initial turn-on of the coil driver is disclosed. The turn-on circuit includes a control signal input node, a capacitor, a resistor, a diode, and a coil driver. The control signal input node receives a coil control signal from an ignition control system. The capacitor begins charging as the control signal is received by the turn-on circuit. As the capacitor charges it gradually increases the voltage provided to the coil driver. The rate of the increase in voltage is controlled by the selection of the resistor and capacitor. The slowing of the initial turn-on of the coil driver has the effect of attenuating the feed forward voltage. The attenuating of the feed forward voltage minimizes degradation of the spark gap while allowing the elimination of the high voltage zener diode.

19 Claims, 3 Drawing Sheets

TURN-ON COIL DRIVER FOR ELIMINATING SECONDARY DIODE IN COIL-PER-PLUG IGNITION COILS

BACKGROUND

1. Field of the Invention

The present invention generally relates to controlling an ignition coil. More specifically, the invention relates to a turn-on circuit for controlling an ignition coil.

2. Description of Related Art

In the area of ignition coils a high voltage zener diode is used in the standard design of a secondary circuit for a coil-per-plug (CPP) automotive ignition coil. The high voltage zener diode attenuates a voltage created in the secondary coil at the instant the coil is first turned on, also known as turn-on voltage or feed forward voltage. The high voltage zener diode precludes the feed forward voltage from causing early ignition.

The high voltage zener diode is a high cost component due to the high voltage value of the diode and its specialized purpose. The cost of the high voltage zener diode is a significant factor in the cost of the coil driver circuit and would represent a significant savings if eliminated. However, the high voltage zener diode in the prior art designs performs an essential function in reducing the feed forward voltage. Reducing the feed forward voltage prevents an over advanced spark which may cause early ignition and minimizes degradation of the spark gap. An over advanced spark could cause engine roughness, higher emissions, and increased fuel consumption.

In addition, removal of the high voltage zener diode may become vital for ODBII compliance, which mandates misfire detection. Ionization misfire detection with the ignition system is not possible if the high voltage zener diode is used because high voltage zener diode will block the ionization signal needed for misfire detection.

In view of the above, it is apparent that there exists a need for an improved circuit for controlling an ignition coil.

SUMMARY

In satisfying the above need, as well as overcoming the enumerated drawbacks and other limitations of the related art, an embodiment of the present invention provides a turn-on coil driver circuit that attenuates the feed forward voltage by slowing the initial turn-on of the coil driver. In addition, the diode provides a path for quickly discharging the capacitor.

The turn-on circuit includes a control signal input node, a capacitor, a resistor, a diode, and a coil driver. The control signal input node receives a coil control signal from an ignition control system. The capacitor begins charging after the control signal is received by the turn-on circuit. As the capacitor charges it gradually increases the voltage provided to the coil driver. The rate of the increase in voltage is controlled by the selection of the resistor and capacitor. The slowing of the initial turn-on of the coil driver has the effect of attenuating the feed forward voltage. The attenuating of the feed forward voltage minimizes degradation of the spark gap while alleviating the need for the high voltage zener diode.

Additionally, the turn-on circuit provides a diode to ensure quick discharge of the capacitor. Quick discharge of the capacitor is necessary so that the field of the coil is collapsed rapidly and the maximum secondary voltage is available to break down the spark plug gap when the coil is next fired.

Further, the present invention will permit the use of the smaller spark plug gap. The smaller spark plug gap and elimination of the high voltage zener diode would improve the signal strength and signal-to-noise ratio of an ionization misfire detection system.

Further objects, features and advantages of this invention will become readily apparent to persons skilled in the art after a review of the following description, with reference to the drawings and claims that are appended to and form a part of this specification.

DETAILED DESCRIPTION

Figure 1:
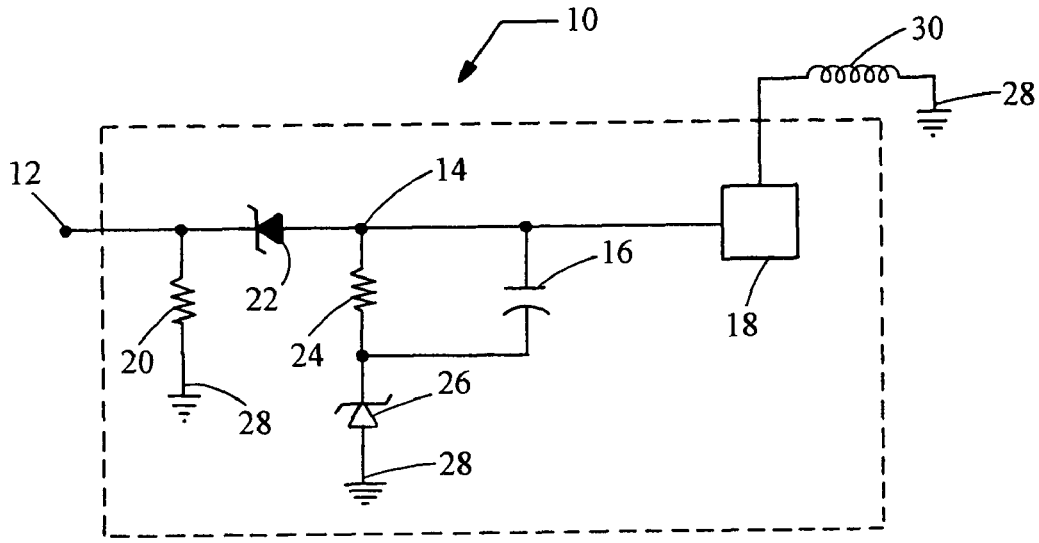
FIG. 1 is a diagrammatic view of the turn-on coil driver circuit for controlling an ignition coil according to the present invention.
Figure 2:
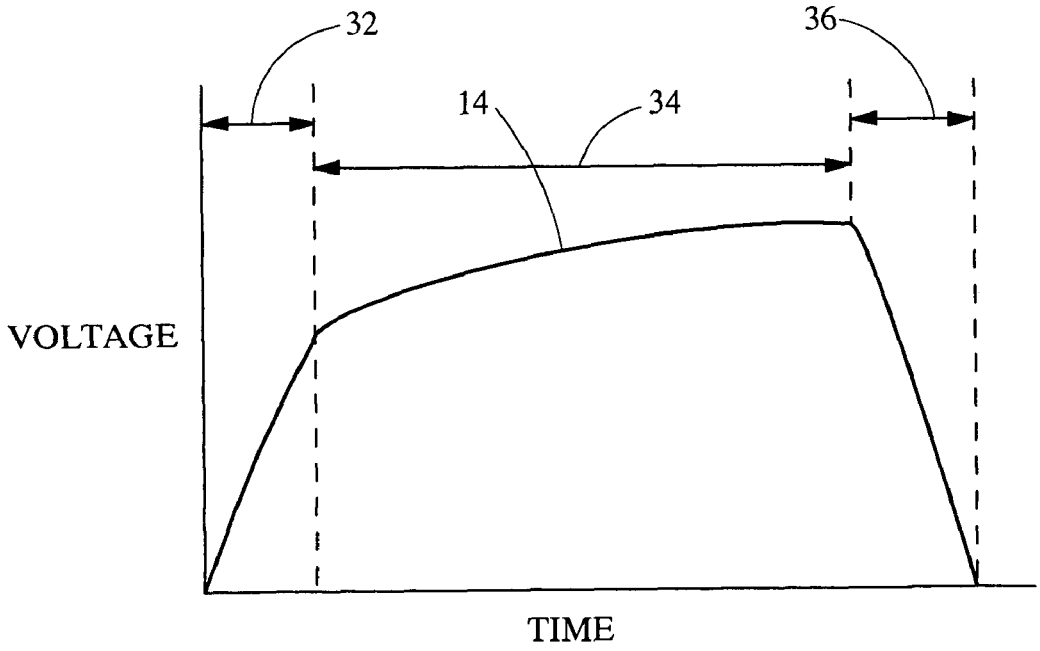
FIG. 2 is a voltage plot of the coil driver output node for the turn-on circuit according to the present invention.

Referring now to FIGS. 1 and 2, a turn-on coil driver circuit embodying the principles of the present invention is illustrated therein and designated at 10. The turn-on coil driver circuit 10 includes a control signal input node 12 a capacitor 16 a resistor 24, a zener diode 22, and a coil driver circuit 18. Coil driver circuit 10 is configured to energize an ignition coil 30.

Control signal input node 12 receives a control signal from a coil control module (not shown) to initiate activation of coil driver circuit 18 thereby energizing the coil 30. Zener diode 22 is connected between control signal input node 12 and coil driver output node 14. Zener diode 22 is oriented such that the cathode of zener diode 22 is connected to the control signal input node 12 and the anode of zener diode 22 is connected to coil driver output node 14.

Capacitor 16 is connected on a first side to the coil driver output node 14 and a second side of capacitor 16 is in communication with an electrical ground 28 through zener diode 26. Zener diode 26 is oriented such that the cathode of zener diode 26 is connected to capacitor 16 and anode of zener diode 26 is connected to electrical ground 28. Further, resistor 24 is connected between the cathode of zener diode 26 and coil driver output node 14.

As the control signal is received by control signal input node 12 capacitor 16 the voltage at coil driver output node 14 jumps to a level just below where the coil driver 18 begins to turn on, as shown in FIG. 2, during time period 32. The effective resistance provided by zener diode 22 in cooperation with resistor 24 will allow capacitor 16 to charge gradually over the charging time period 34. As the voltage increases coil driver 18 begins to fire coil 30 to initiate ignition.

Conversely, it is also important that the coil field collapse quickly after coil 30 has been fired. Therefore, capacitor 16 is allowed to discharge quickly via the path to electrical ground 28 created through zener diode 22 and resistor 20. Resistor 20 is connected between cathode of zener diode 22 and electrical ground 28. The value of resistor 20 is chosen so the discharge time period 36 of capacitor 16 is small in comparison to the charging time period 34. Utilizing the capacitor 16 in this manner allows low voltage zener diodes to be used for zener diode 22 and zener diode 26 thereby eliminating the need for a high voltage zener diode.

Figure 3:
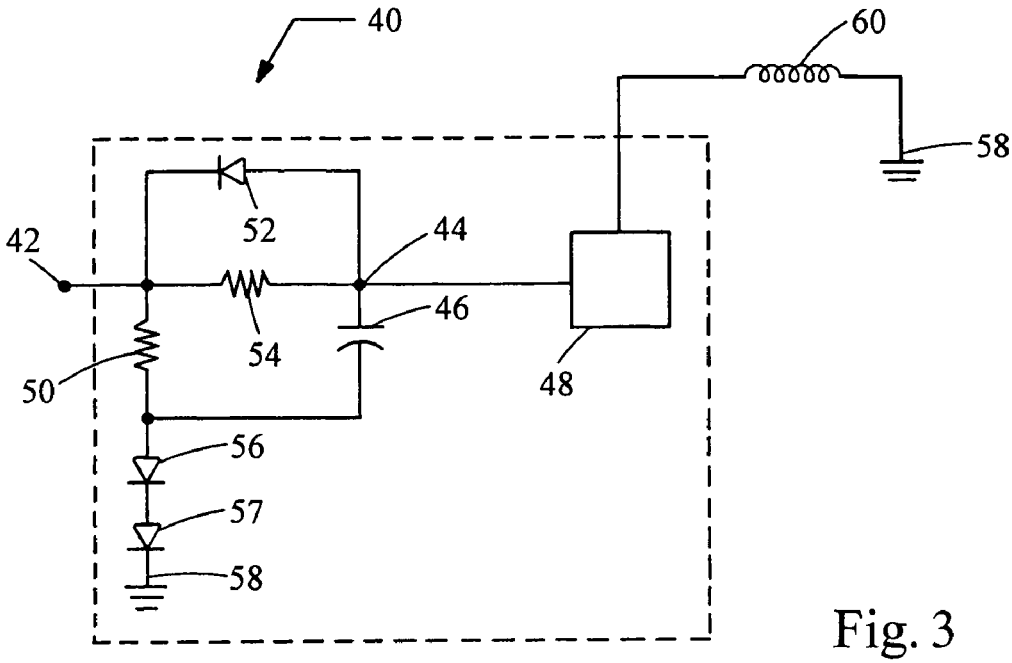
FIG. 3 is a diagrammatic view showing another embodiment of a turn-on coil driver circuit for controlling an ignition coil according to the present invention.

Now referring to FIG. 3, another embodiment of a turn-on coil driver circuit according to the present invention is illustrated therein and designated at 40. The turn-on coil driver circuit 40 includes a control signal input node 42, a capacitor 46, a resistor 54, a diode 52, and a coil driver 48.

The control signal input node 42 receives a control signal from a coil control module (not shown) to initiate activation of the coil driver circuit 48 thereby firing coil 60. Resistor 54 is connected between the control signal input node 42 and the coil driver output node 44.

Capacitor 46 is connected on a first side to the coil driver output node 44 and the second side is in communication with an electrical ground 58 through diodes 56 and 57. Diodes 56 and 57 are oriented such that the anode of diode 56 is connected to the capacitor 46, the cathode of diode 56 is connected to the anode of diode 57, and the cathode of diode 57 is connected to electrical ground 58. Further, resistor 54 is connected between the control signal input node 42 and the coil driver output node 44.

As the control signal is received by the control signal input node 42 the voltage at the coil driver output node 44 jumps to a level just below where the coil driver 48 begins to turn on. The resistance provided by resistor 54 will allow the capacitor 46 to charge gradually over the charging time period. As the voltage increases the coil driver 48 fires coil 60 to initiate ignition.

Capacitor 46 is allowed to discharge quickly via the path to electrical ground 58 created through diode 52, resistor 50, diode 56, and diode 57. Diode 52 is connected between the control signal input node 42 and the coil driver output node 44. Diode 52 is oriented such that the cathode of diode 52 is connected to the control signal input node 42 and the anode of diode 52 is connected to the coil driver output node 44. Resistor 50 is connected between the cathode of diode 52 and the anode of diode 56. The value of resistor 50 is chosen so the discharge time period of capacitor 46 is small in comparison to the charging time period.

Figure 4:
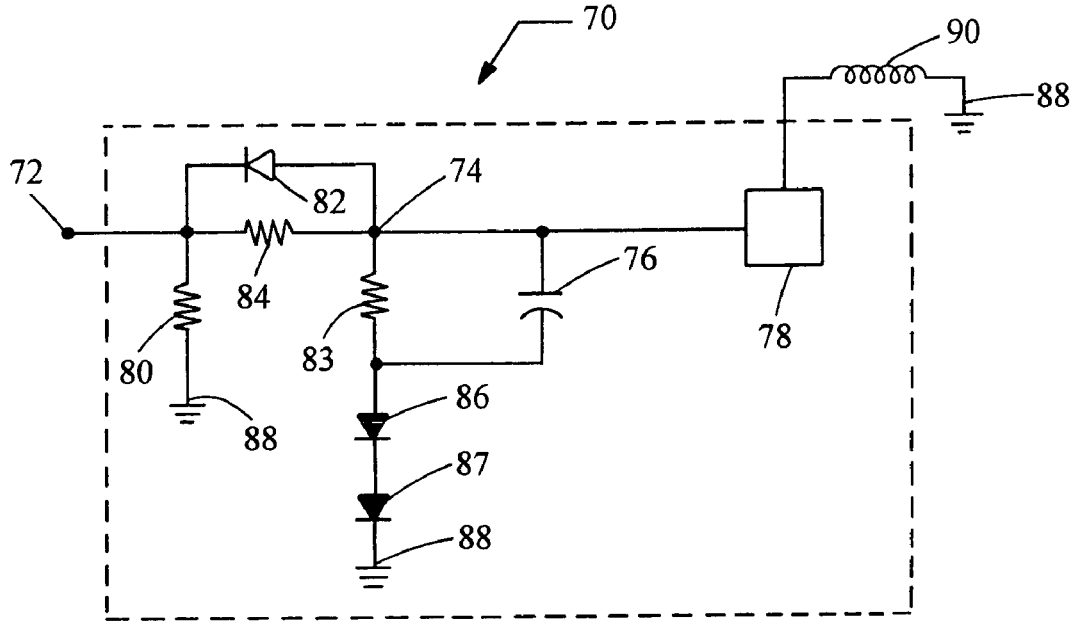
FIG. 4 is a diagrammatic view showing another embodiment of a turn-on coil driver circuit for controlling an ignition coil according to the present invention.

Now referring to FIG. 4, yet another embodiment of a turn-on coil driver circuit according to the present invention is illustrated therein and designated at 70. As its primary components, the turn-on coil driver circuit 70 includes a control signal input node 72 a capacitor 76 a resistor 84, a diode 82, in the coil driver 48.

The control signal input node 72 receives a control signal from a coil control module (not shown) to initiate activation of the coil driver circuit 78 thereby firing the coil 90. Resistor 84 is connected between the control signal input node 72 and the coil driver output node 74.

Capacitor 76 is connected on a first side to the coil driver output node 74 and the second side is in communication with an electrical ground 88 through diodes 86 and 87. Diodes 86 and 87 are oriented such that the anode of diode 86 is connected to the capacitor 76, the cathode of diode 86 is connected to the anode of diode 87, and the cathode of diode 87 is connected to electrical ground 88. Further, resistor 83 is connected between the anode of diode 86 and the coil driver output node 74.

As the control signal is received by the control signal input node 74 capacitor 76 the voltage at the coil driver output node 74 jumps to a level just below where the coil driver 78 begins to turn on. The resistance provided by resistor 84 in cooperation with resistor 83 will allow the capacitor 76 to charge gradually over the charging time period. As the voltage increases the coil driver 78 fires coil 90 to initiate ignition.

Capacitor 76 is allowed to discharge quickly via the path to electrical ground 88 created through diode 82 and resistor 80. Resistor 80 is connected between the cathode of diode 82 and electrical ground 88. Diode 82 is connected between the control signal input node 72 and the coil driver output node 74. Diode 82 is oriented such that the cathode of diode 82 is connected to the control signal input node 72 and the anode of diode 82 is connected to the coil driver output node 74. The value of resistor 80 is chosen so the discharge time period of capacitor 76 is small in comparison to the charging time period.

Figure 5:
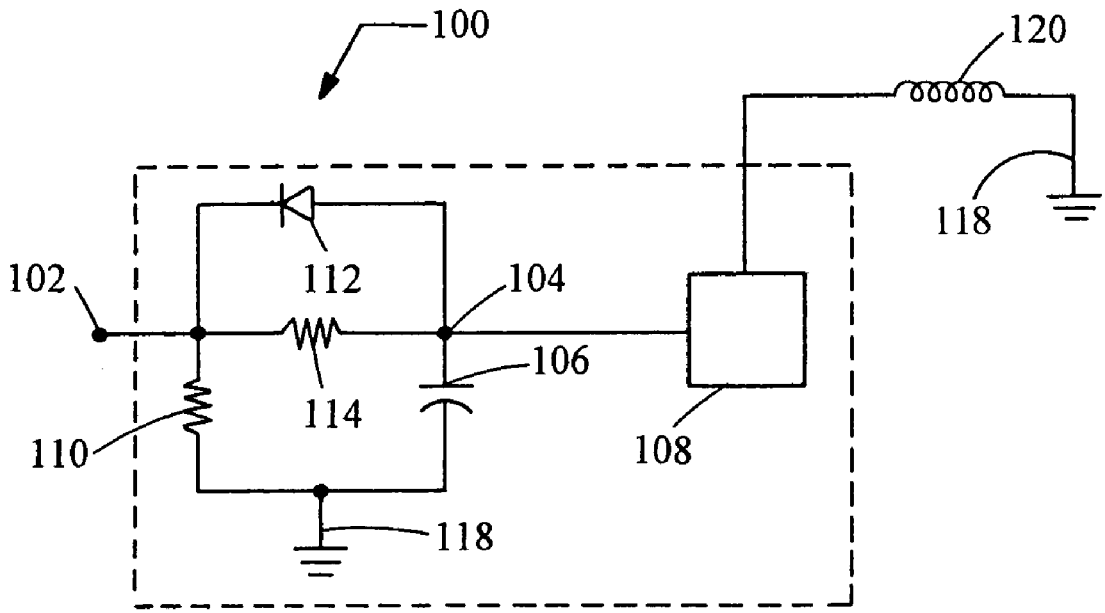
FIG. 5 a diagrammatic view showing yet another embodiment of a turn-on coil driver circuit for controlling an ignition coil according to the present invention.

Now referring to FIG. 5, another embodiment of a turn-on coil driver circuit according to the present invention is illustrated therein and designated at 100. As its primary components, the turn-on coil driver circuit 100 includes a control signal input node 102 a capacitor 106 a resistor 114, a diode 112, in the coil driver 108.

The control signal input node 102 receives a control signal from a coil control module (not shown) to initiate activation of the coil driver circuit 108 thereby firing the coil 120. Resistor 114 is connected between the control signal input node 102 and the coil driver output node 104. Diode 112 is connected between the control signal input node 102 and the coil driver output node 104. Diode 112 is oriented such that the cathode of diode 112 is connected to the control signal input node 102 and the anode of diode 112 is connected to the coil driver output node 104.

Capacitor 106 is connected on a first side to the coil driver output node 104 and the second side is in communication with an electrical ground 118. As the control signal is received by the control signal input node 102 the resistance provided by resistor 112 will allow the capacitor 106 to charge gradually over the charging time period. As the voltage increases the coil driver 108 fires coil 120 to initiate ignition.

Capacitor 106 is allowed to discharge quickly via the path to electrical ground 118 created through diode 112 and resistor 110. Diode 112 is connected between the control signal input node 102 and the coil driver output node 104. Diode 112 is oriented such that the cathode of diode 112 is connected to the control signal input node 102 and the anode of diode 112 is connected to the coil driver output node 104. Resistor 110 is connected between the cathode of diode 112 and electrical ground 118. The value of resistor 110 is chosen so the discharge time period of capacitor 106 is small in comparison to the charging time period.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

We claim:

1. A circuit for controlling an ignition coil comprising:

a coil driver in communication with the ignition coil;

a first node for receiving a coil control signal;

a second node connected to the coil driver;

a capacitor in communication with the second node, to gradually increase a voltage at the second node to energize the ignition coil; and a first diode having a cathode in communication with the first node and an anode in communication with the capacitor for providing a discharge path to discharge the capacitor after the ignition coil has been energized.

2. The circuit according to claim 1, further comprising a first resistor in communication with the capacitor for controlling a charging time period of the capacitor.

3. The circuit according to claim 2, further comprising a second resistor in communication with the capacitor for controlling a discharging time period of the capacitor.

4. The circuit according to claim 3, wherein the charging time period is greater than the discharging time period.

5. The circuit according to claim 2, wherein the first resistor and capacitor are in communication with an electrical ground.

6. The circuit according to claim 5, wherein the first diode is a low voltage zener diode.

7. The circuit according to claim 2, wherein the anode of the first diode is connected to the first resistor and the capacitor.

8. The circuit according to claim 7, wherein the first resistor, the capacitor, and the anode of the first diode are connected to the second node.

9. The circuit according to claim 2, comprising a second diode connected between the first resistor and an electrical ground.

10. The circuit according to claim 9, wherein the cathode of the second diode is connected with the electrical ground.

11. The circuit according to claim 10, comprising a third diode wherein the third diode is connected between the first resistor and the anode of the second diode.

12. The circuit according to claim 9, wherein the second diode is connected between the capacitor and the electrical ground.

13. The circuit according to claim 9, wherein the second diode is a low voltage zener diode.

14. The circuit according to claim 9, wherein the anode of the second diode is in electrical communication with the electrical ground.

15. The circuit according to claim 3, comprising a third resistor connected between the first resistor and the capacitor.

16. The circuit according to claim 15, wherein a first end of the third resistor is in communication with the input node and a second end of the third resistor is in communication with the capacitor.

17. The circuit according to claim 15, wherein the first diode is in electrical parallel connection with the third resistor.

18. A method for controlling an ignition coil comprising the steps of:

increasing the voltage to the ignition coil quickly to a level just below the coil firing voltage;

increasing the voltage to the ignition coil during an ignition period to reduce the feed forward voltage; and discharging the voltage to the ignition coil quickly after the ignition period.

19. The circuit according to claim 3, wherein the second resistor is connected between the first node and an electrical ground.

* * * * *